US008857784B2

(12) United States Patent
Shimonek et al.

(10) Patent No.: US 8,857,784 B2
(45) Date of Patent: Oct. 14, 2014

(54) LINEAR CLUTCH FOR BLOWOUT PREVENTER

(71) Applicant: Cameron International Corporation, Houston, TX (US)

(72) Inventors: Steven F. Shimonek, League City, TX (US); Charles E. Gibbs, Stafford, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/629,152

(22) Filed: Sep. 27, 2012

(65) Prior Publication Data

US 2014/0084192 A1 Mar. 27, 2014

(51) Int. Cl.
*E21B 33/06* (2006.01)

(52) U.S. Cl.
USPC ..... 251/1.3; 251/60; 166/323

(58) Field of Classification Search
CPC ..... F16K 1/00; E21B 33/06; E21B 33/061; E21B 33/062; E21B 33/063
USPC ..... 251/1.3, 1.1, 285, 60, 284; 166/363, 166/86.3, 86.1, 332
See application file for complete search history.

(56) References Cited

U.S. PATENT DOCUMENTS 4,076,208 A 2/1978 Olson
4,188,860 A * 2/1980 Miller ..... 92/15
4,624,311 A 11/1986 Goad
4,658,904 A 4/1987 Doremus et al.
4,712,471 A 12/1987 Johnson
5,025,708 A * 6/1991 Smith et al. ..... 92/19
5,287,879 A * 2/1994 Leggett et al. ..... 137/246.22
5,575,452 A 11/1996 Whitby et al.
6,843,463 B1 * 1/2005 McWhorter et al. ..... 251/1.1
7,300,033 B1 11/2007 Whitby et al.
7,338,027 B1 * 3/2008 Whitby et al. ..... 251/1.3
7,798,251 B2 9/2010 Eriksen et al.

OTHER PUBLICATIONS

Cameron International Corporation, "EVO Product Line" brochure, dated Nov. 2011.
Cameron International Corporation, "20K EVO BOP" brochure, dated Feb. 2011.
Thomas, International Search Report and Written Opinion for PCT/US2013/061165, mailed Feb. 24, 2014.

* cited by examiner

*Primary Examiner* — John K Fristoe, Jr.
*Assistant Examiner* — Andrew J Rost
(74) *Attorney, Agent, or Firm* — Eubanks PLLC

(57) ABSTRACT

Linear clutches for reducing axial loads in a system are provided. In one embodiment, a system includes a blowout preventer having a ram coupled to an actuation assembly. A locking assembly is positioned within the system to enable an end of the locking sleeve to engage the actuation assembly and to lock the actuation assembly and the ram into place. In this embodiment, the locking sleeve is segmented and includes at least one groove to engage a complementary surface of the actuation assembly. Additional systems, devices, and methods are also disclosed.

20 Claims, 7 Drawing Sheets

FIG. 12
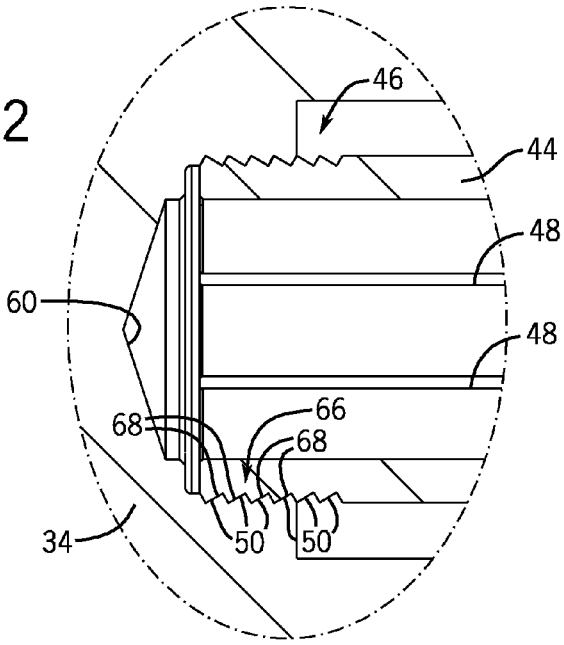
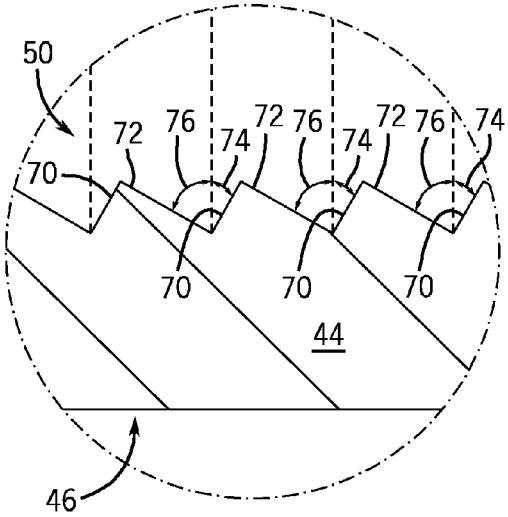
FIG. 13
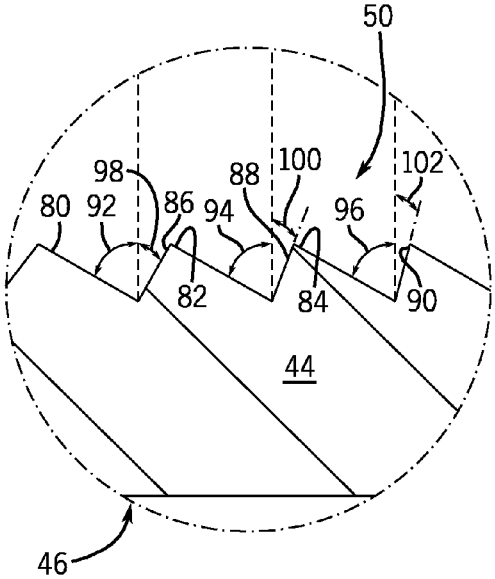
FIG. 14

LINEAR CLUTCH FOR BLOWOUT PREVENTER

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

More particularly, wellhead assemblies often include a blowout preventer, such as a ram-type blowout preventer that uses one or more pairs of opposing rams that press against one another to restrict flow of fluid through the blowout preventer. The rams typically include sealing elements (also referred to as ram packers) that press together when two opposing rams close against one another. In some instances, locking devices are used to lock the rams in their closed positions. But changes in pressure within the blowout preventer can increase axial loading on the locking devices. And in some instances this loading can cause difficulties in unlocking the rams.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to locking devices. The locking devices of at least some embodiments include linear clutches that maintain axial loading on the locking devices within a designed loading range. In one embodiment, such locking devices are provided in a blowout preventer for locking rams in their closed positions. When the axial loading on the locking devices exceeds the designed loading range, the linear clutches allow the rams to move to release potential energy and to reduce axial loading on the locking devices. A locking sleeve of one embodiment includes a segmented end with one or more grooves to engage a complementary surface of an actuation assembly of a ram. When the locking sleeve is engaged in this manner, the ram and the actuation assembly are locked in place while still allowing discrete movement by these components to reduce axial loading on the locking device.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein:

FIG. 12 is a detail view similar to FIG. 11 but showing the piston driven further along the end of the locking sleeve such that more of the mating grooves of the locking sleeve and the piston recess engage one another;

FIG. 13 is a detail view taken along line 13-13 of FIG. 10 and depicts a series of grooves on the end of the locking sleeve in which the grooves are formed with identical locking angles in accordance with one embodiment;

FIG. 14 is a detail view similar to that of FIG. 13, but instead shows grooves on the end of a locking sleeve that are formed with different locking angles in accordance with another embodiment.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
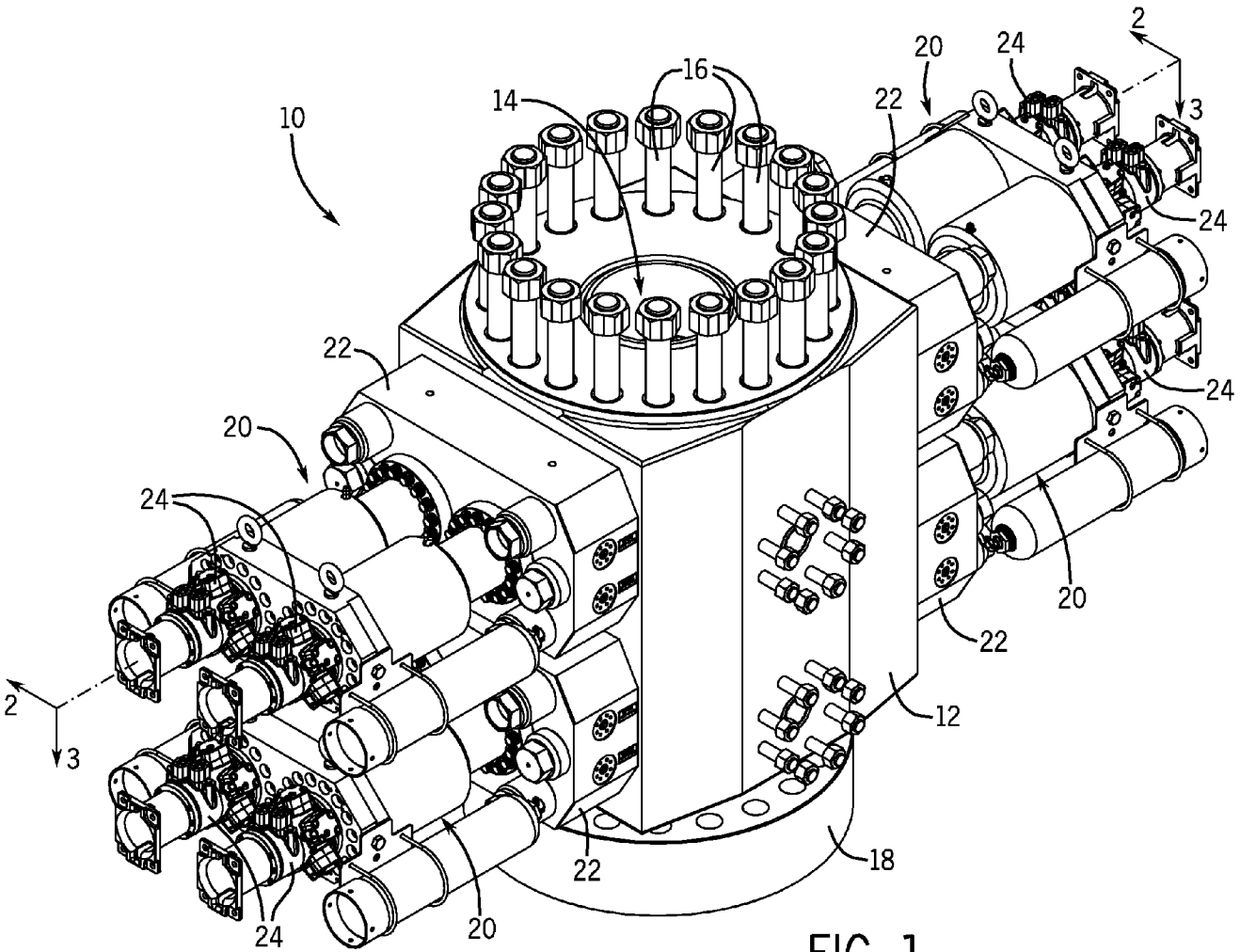
FIG. 1 is a perspective view of a blowout preventer having rams that may be extended into a bore of the blowout preventer to restrict flow through the bore in accordance with an embodiment of the present disclosure.

Turning now to the drawings, a blowout preventer 10 is illustrated in FIG. 1 by way of example. The depicted blowout preventer 10 includes a hollow main body 12 and a bore 14 that enables passage of fluid or tubular members through the blowout preventer 10. As will be appreciated, the blowout preventer 10 may be coupled to other equipment that facilitates natural resource production. For instance, production equipment or other components may be attached to the top of the blowout preventer 10 via fasteners 16 (provided in the form of studs and nuts in FIG. 1) and the blowout preventer 10 may be attached to a wellhead or spool via flange 18 and additional fasteners.

Bonnet assemblies 20 of the blowout preventer 10 include bonnets 22 secured to the main body 12. The bonnet assemblies 20 include cylinders that house various components that facilitate control of rams 30 (FIG. 2) disposed in the blowout preventer 10. In the presently depicted embodiment, and as set forth in greater detail below, motors 24 drive some of these components while others operate in response to hydraulic pressure from control fluid.

Figure 2:
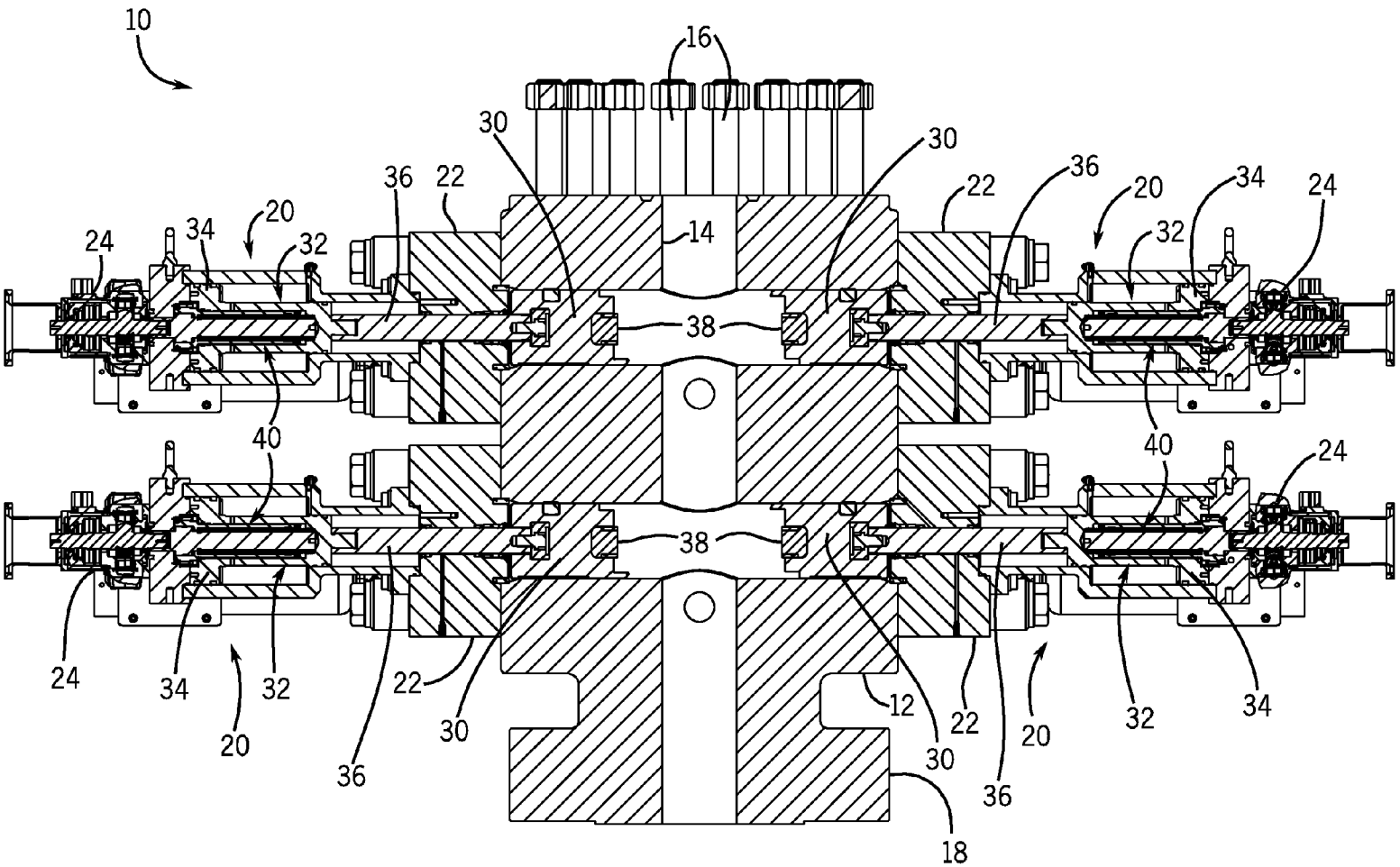
FIG. 2 is a vertical cross-section of the blowout preventer of FIG. 1, depicting operating piston assemblies coupled to rams and locking assemblies for securing the rams in a desired position in accordance with one embodiment.
Figure 3:
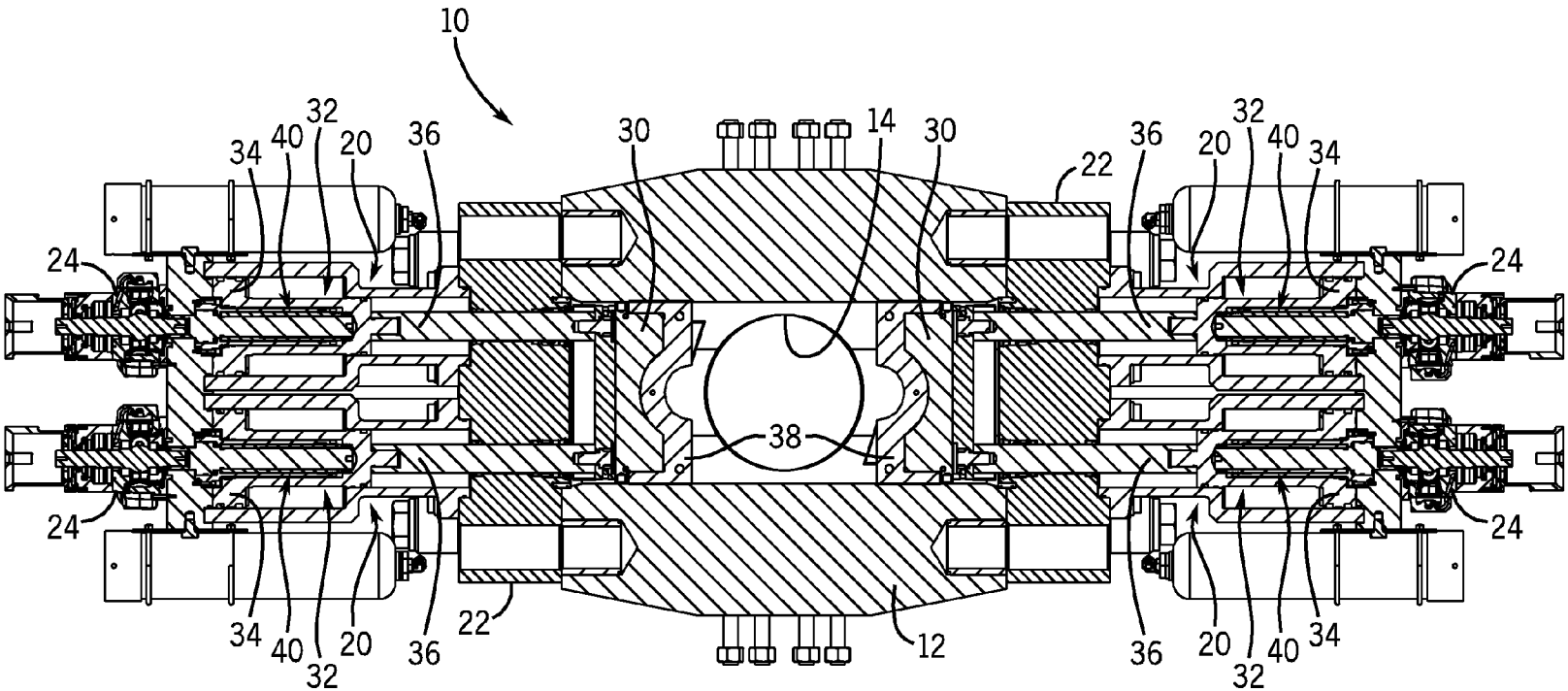
FIG. 3 is a horizontal cross-section of the blowout preventer of FIG. 1 that also depicts operating piston assemblies, rams, and locking assemblies of the blowout preventer.

As illustrated in the cross-sections of FIGS. 2 and 3, the blowout preventer 10 includes rams 30 controlled by actuation assemblies 32 having operating pistons 34 and connecting rods 36. More specifically, the blowout preventer 10 is here depicted as a double-ram blowout preventer having two pairs of rams 30. The rams 30 in FIG. 2 are depicted as pipe rams having sealing elements 38 (also known as ram packers) that cooperate with one another when driven together to seal about a pipe or other tubular member and inhibit flow through the bore 14 of the blowout preventer 10. In other embodiments, one or both pairs of rams 30 could take other forms, such as blind rams or shear rams. Further, in other embodiments the blowout preventer 10 may have a different number of rams. For example, the blowout preventer 10 could instead be a single-ram blowout preventer with one pair of rams or a triple-ram blowout preventer with three pairs of rams. The number of rams, along with their types and sizes, may be selected based on the intended application.

In operation, a force (e.g., from hydraulic pressure provided by control fluid from accumulator bottles) may be applied to the operating pistons 34 to drive the rams 30, via the connecting rods 36, into the bore 14 of the blowout preventer 10. The connecting rods 36 extend through the bonnets 22 and enable forces on the pistons 34 to be transmitted to the rams 30. Various seals may be provided between the connecting rods 36 and the bonnets 22 to inhibit leaking while enabling axial movement of the connecting rods through the bonnets. Although the rams 30 are illustrated as hydraulically actuated rams in the presently depicted embodiment, it is noted that the rams 30 could be actuated in any other suitable manner as well.

In the embodiment shown in FIG. 3, each ram 30 is controlled by two actuation assemblies 32. Because hydraulic force on the operating pistons 34 is proportional to the surface areas to which pressure is applied, the two pistons 34 per ram 30 allow the pistons 34 to cumulatively provide the same reactive surface area as a single, larger piston 34. This, in turn, enables a compact design with bonnet assemblies 20 occupying less vertical space along the blowout preventer 10. But in other embodiments each ram 30 is controlled by a different number of actuation assemblies 32, such as arrangements in which a single actuation assembly 32 is provided for each ram 30.

Again with reference to FIGS. 2 and 3, and as discussed in greater detail below, the blowout preventer 10 includes locking assemblies 40 for holding the rams 30 in fixed positions, such as in closed positions in which the rams 30 seal the bore 14. The locking assemblies 40 are driven by the motors 24, although in other embodiments the locking assemblies 40 could also or instead be actuated mechanically or in any other suitable manner. Once moved into their locked positions, the locking assemblies 40 generally maintain the rams 30 in their set positions. This allows, for example, the rams 30 to be held in closed positions to seal the bore 14 regardless of changes in hydraulic pressure on the rams 30 (e.g., from wellbore pressure applied to rear faces of the rams opposite the ram packers 38) or on the actuation assemblies 32 (e.g., from reductions of hydraulic closing pressure on the pistons 34).

But potential energy is stored in the ram packers 38 when the rams 30 are closed. Particularly, wellbore pressure on the closed rams 30 can cause significant compression of elastomeric ram packers 38. And once the locking assemblies 40 are moved into locked positions and the pressure on the rams 30 or on the actuation assemblies 32 is reduced (such as by removing the wellbore pressure from the rams), the potential energy of the ram packers 38 cause the rams 30 to load against the locking assemblies 40. Left unchecked, such loading would increase the force needed to unlock the locking assemblies 40 from the rams 30. More specifically, a load on an actuation assembly 32 from the ram 30 would be transmitted to the locking assembly 40. If the transmitted load were sufficiently high, the motor 24 would have insufficient torque to disengage the locking assembly 40. In such an instance, hydraulic pressure could be applied to the operating piston 34 to provide a contrary force that reduces the net force on the locking assembly 40 to a level at which the motor 24 could then disengage the locking assembly 40. But such a solution would require additional time and would rely on the capability to supply enough hydraulic pressure to the operating piston 34 to sufficiently counter the load from the compressed ram packers 38.

Consequently, in the presently depicted embodiment the locking assemblies 40 include linear clutches in the form of locking sleeves 44 that cooperate with the actuation assemblies 32 to reduce axial loading on the locking assemblies 40 from the compressed ram packers 38. The locking sleeves 44 are constructed to resist movement of the actuation assemblies 32 when the sleeves 44 are moved into locked positions. But the sleeves 44 also permit small amounts of movement of the assemblies 32 with respect to the sleeves 44 when compressive axial loading from the energy stored in the ram packers 38 exceeds an upper threshold of a designed load range of the system. These small movements cause partial decompression of the ram packers 38, which reduces both the potential energy they store and the axial loading on the locking sleeves 44.

Figure 4:
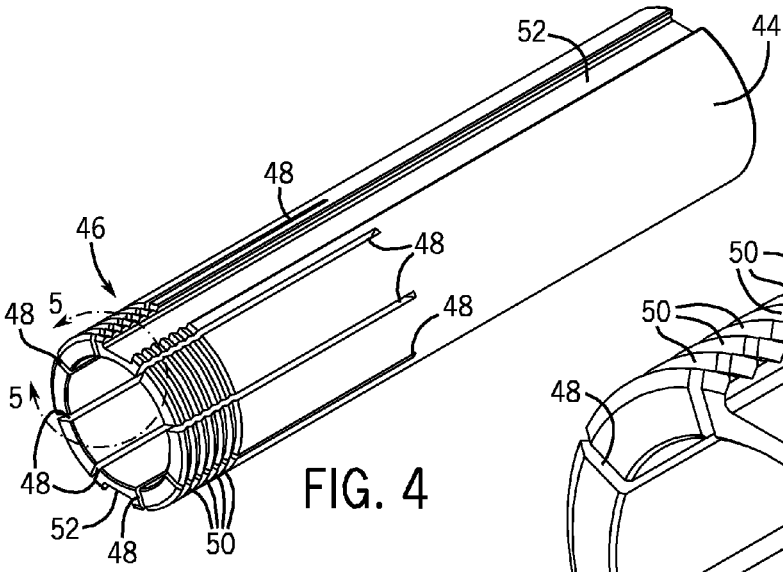
FIG. 4 depicts one example of a locking sleeve of the locking assemblies depicted in FIGS. 2 and 3.
Figure 5:
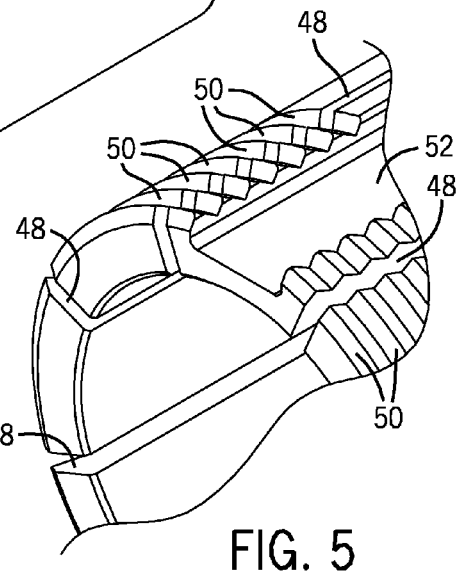
FIG. 5 is a detail view of an end of the locking sleeve of FIG. 4.

One example of such a locking sleeve 44 is depicted in FIGS. 4 and 5. This locking sleeve 44 includes a segmented end 46 with slots 48 and concentric grooves 50 spaced axially apart on its outer surface. As described in greater detail below, the segmented end 46 of the locking sleeve 44 may be moved into engagement with the piston 34 or another component of the actuation assembly 32 to hold the ram 30 in a closed position within the bore 14 of the blowout preventer 10, while the slots 48 and the grooves 50 enable discrete movements of the ram 30 while in its closed position to reduce axial loading on the locking sleeve 44. As here depicted, the locking sleeve 44 also includes channels or keyways 52 that cooperate with keys of an outer sleeve 58 (FIG. 6) to inhibit rotation of the locking sleeve 44 about its axis while permitting axial movement of the sleeve 44.

Figure 6:
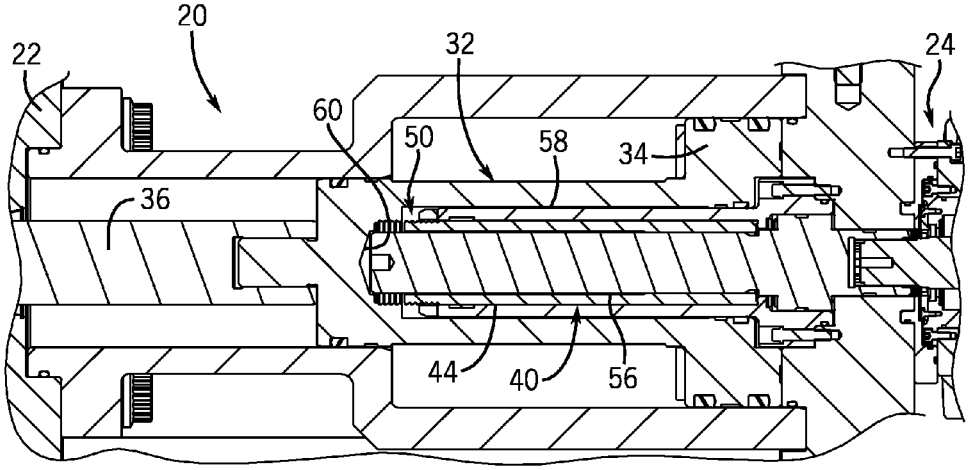
FIG. 6 depicts, in accordance with one embodiment, a position of an operating piston and a locking assembly associated with the ram being in an open position within the blowout preventer.
Figure 7:
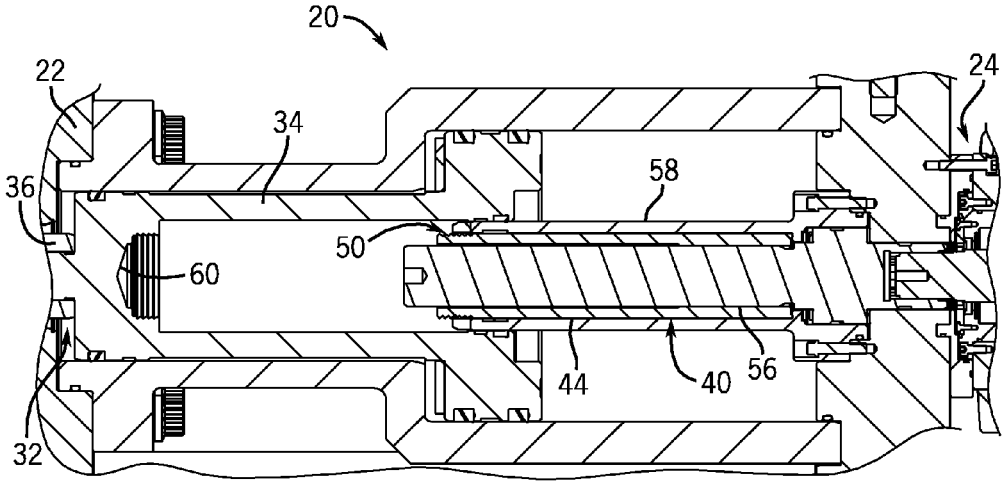
FIG. 7 depicts the position of the operating piston and the locking assembly of FIG. 6 after pressure is applied to the operating piston to drive the ram into a closed position within the blowout preventer.
Figure 8:
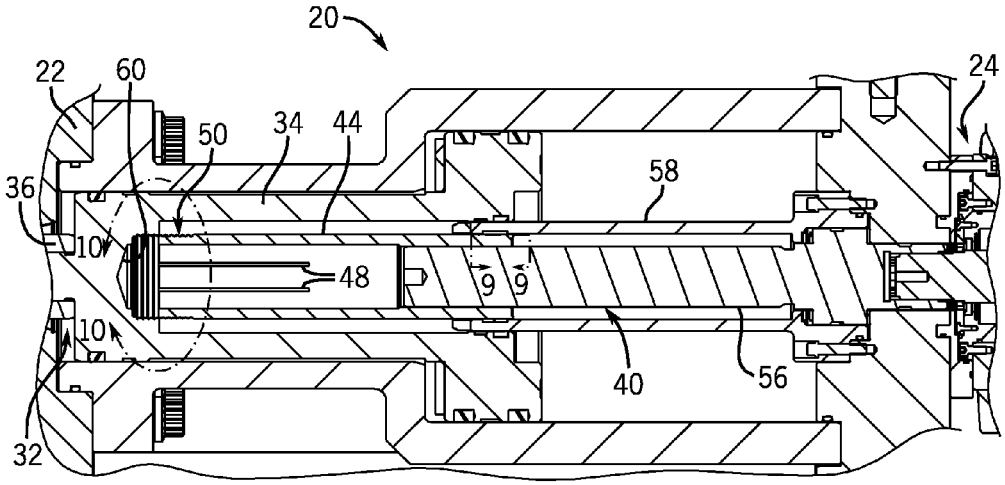
FIG. 8 depicts the position of the operating piston and the locking assembly of FIG. 7 after the locking sleeve of the locking assembly is driven into engagement with the operating piston to secure the ram in the closed position within the blowout preventer.

Additional elements of a locking assembly 40 in accordance with one embodiment are illustrated in FIGS. 6-8. As shown, the locking assembly 40 includes a locking rod 56 and an outer sleeve 58. In the present arrangement, the locking sleeve 44 is threaded onto the locking rod 56. Rotation of the locking rod 56 causes axial translation of the locking sleeve 44 along the locking rod 56. In this embodiment, the motor 24 is connected to drive rotation of the locking rod 56 and, thus, axial movement of the locking sleeve 44. The outer sleeve 58 is disposed radially outward from the locking sleeve 44 and, through keyed engagement, inhibits rotation of the locking sleeve 44 while it is driven by the rotation of the locking rod 56. The operating piston 34 is positioned on the outer sleeve 58 in a manner that allows the piston 34 to move along the outer sleeve 58 in response to an applied force (e.g., from hydraulic pressure). The piston 34 also includes a recess 60 that cooperates with the locking sleeve 44 to reduce excessive axial loading by allowing the piston 34 to be driven onto the sleeve 44, such as in the manner described below.

Operation of the locking assembly 40 in accordance with this embodiment may also be better understood with reference to FIGS. 6-8. More specifically, FIG. 6 depicts the actuation assembly 32 in an open position and the locking assembly 40 in an unlocked position. Hydraulic pressure may be applied to the operating piston 34 to drive the actuation assembly 32 into the closed position depicted in FIG. 7. Of course, this also drives a ram 30 coupled to the end of the connecting rod 36 from an open, retracted position into a closed, sealing position within the bore 14 of the blowout preventer 10. The locking sleeve 44 may then be extended to engage the operating piston 34, as shown in FIG. 8. Once in this locked position, the locking sleeve 44 holds the operating piston 34 (and, by extension, the connecting rod 36 and its ram 30) in the closed position.

Figure 9:
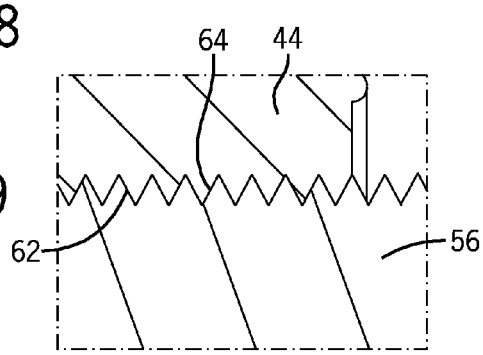
FIG. 9 is a detail view taken along line 9-9 in FIG. 8 and depicts a threaded engagement of the locking sleeve to a rod of the locking assembly that enables axial translation of the locking sleeve by rotation of the rod.

As generally depicted in FIG. 9, the locking sleeve 44 and the locking rod 56 include mating threads 62 and 64. Through this mating engagement, rotation of the locking rod 56 (e.g., by motor 24) is converted into axial movement of the locking sleeve 44 along the locking rod 56. Particularly, starting with the locking sleeve 44 in its unlocked position as shown in FIG. 7, rotation of the locking rod 56 in one direction causes the locking sleeve 44 to extend outwardly from the locking rod 56 toward the locked position shown in FIG. 8. And the locking rod 56 could be rotated in the opposite direction to disengage the locking sleeve 44 from the piston 34 and retract it onto the locking rod 56.

Figure 10:
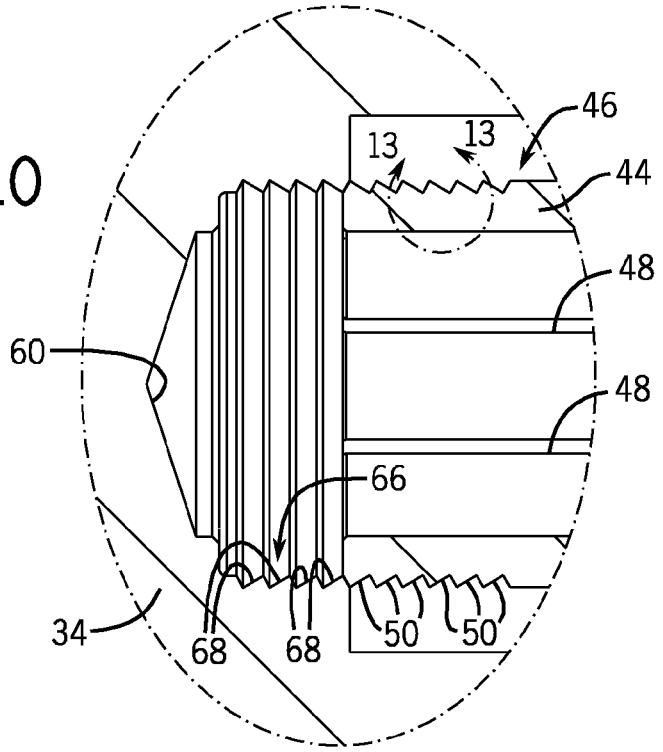
FIG. 10 is a detail view taken along line 10-10 in FIG. 8 and depicts engagement of the locking sleeve with the operating piston.

A detail view of the engagement of the locking sleeve 44 with the piston 34 when the locking sleeve 44 is extended into its locked position is provided in FIG. 10. In this figure, the segmented end 46 of the locking sleeve 44 abuts the piston 34, which holds an attached ram 30 in its closed position as noted above. The locking sleeve 44 is aligned with a recess 60 in the piston 34. The recess 60 has a bore 66 including complementary grooves 68 that cooperate with the segmented end 46 to reduce excess axial loading on the locking sleeve 44 from a compressed ram packer 38 (via the piston 34).

Figure 11:
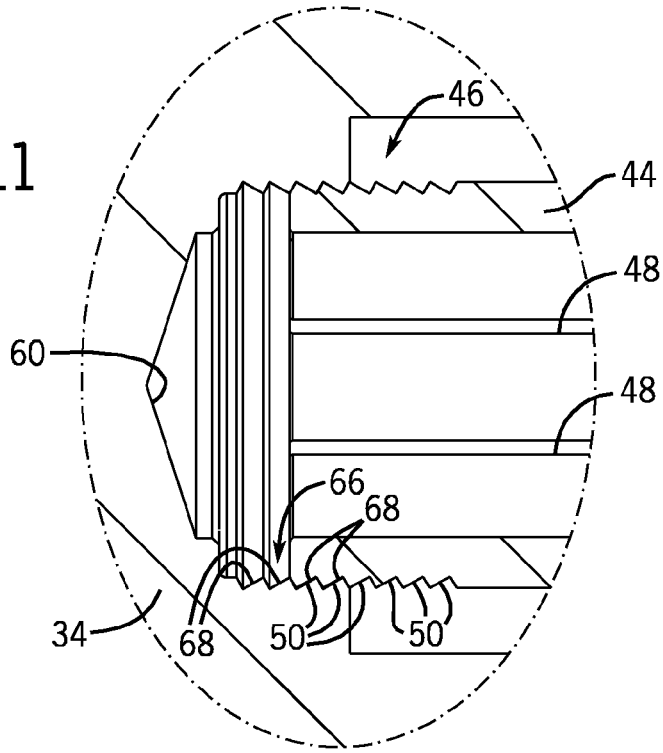
FIG. 11 is a detail view similar to FIG. 10 generally depicting receipt of the operating piston over an end of the locking sleeve such that a grooved surface of a recess of the operating piston engages the grooved end of the locking sleeve.

More specifically, the locking sleeve 44 may be driven into the locked position to create a positive lock against the piston 34, such as depicted in FIGS. 8 and 10. It will be appreciated that a closed ram 30 may be subjected to wellbore pressure that compresses the ram packer 38 while the locking sleeve 44 is moved into the locked position. Subsequent removal of the wellbore pressure from the ram 30 prior to unlocking reduces the compressive hydraulic force on the ram packer 38, resulting in increased axial loading on the locking sleeve 44 (from decompression of the ram packer 38). The locking sleeve 44 is constructed to resist a desired range of axial loading from the ram packer 38 (via the piston 34). The slots 48 enable the segmented end 46 of the locking sleeve 44 to radially contract and expand, allowing the piston 34 to be driven onto the segmented end 46, as generally depicted in FIGS. 11 and 12. This movement of the piston 34 onto the segmented end 46, in turn, allows the ram packer 38 to expand, thus reducing both potential energy stored in the ram packer 38 and axial loading on the locking sleeve 44 from such stored energy.

By way of example, if the axial loading on the locking sleeve 44 is sufficiently high, the interaction of the abutting teeth of grooves 50 and grooves 68 (i.e., the leftmost tooth of the grooves 50 and the rightmost tooth of the grooves 68 in FIG. 10) will cause the segmented end 46 to radially contract enough that the piston 34 will slide over the endmost tooth of grooves 50 on the locking sleeve 44. This movement allows the ram packer 38 to expand, as noted above, and reduces the axial loading on the locking sleeve 44. If the axial loading is still sufficiently high after the piston 34 is driven over the endmost tooth, the interfacing teeth of the grooves 50 and the grooves 68 will again cause the segmented end to radially contract and the piston 34 will be driven over a second tooth of the grooves 50, as depicted in FIG. 11. Similar deflections of the segmented end 46 in response to sufficiently high axial loading will cause the piston 34 to be driven further over additional teeth of the grooves 50 in sequence (e.g., over a third tooth of the grooves 50 and, if axial loading is still high, over a fourth tooth of the grooves 50 (as depicted in FIG. 12)). In this manner, the piston 34 can be said to ratchet through the grooves 50 on the segmented end 46 of the locking sleeve 44 until axial loading on the locking sleeve 44 is reduced below a designed threshold (or until the segmented end 46 bottoms out in the recess 60). Additionally, while the present figures depict a system with six grooves 50 and four grooves 68, it will be appreciated that other embodiments may include any number of such grooves that facilitate the linear clutch functionality described herein.

The locking sleeve 44 is designed to maintain axial loading from the piston 34 (caused by the ram packer 38) on the sleeve 44 within a desired range while in the locked position. That is, the system is constructed to maintain sufficient axial loading on the sleeve 44 to assure sealing of the locked ram 30 while reducing excess axial loading that would have to be overcome in order to return the sleeve 44 to the unlocked position. It is noted that the resistance provided by the sleeve 44 to axial loading from the piston 34 depends on the construction of the sleeve 44. For example, the material (e.g., steel) from which the sleeve 44 is formed impacts its elasticity and the force required to radially compress the segmented end 46. The configuration of the grooves 50 also impacts the amount of resistance provided by the sleeve 44 against the axial loading from the piston 34. Particularly, locking angles of the grooves 50 control the amount of radially directed force applied to the segmented end 46 from the piston 34.

Two examples of different groove configurations on locking sleeves 44 are depicted in FIGS. 13 and 14. In the first example, each groove 50 includes faces 70 and 72 provided at angles 74 and 76, respectively, with respect to a radially directed normal of the sleeve 44. The faces 70 resist axial loading from the compressed ram packer 38 and the corresponding angles 74 may be considered locking angles of the grooves 50. Given the geometry of the system, a smaller locking angle 74 would increase the resistance of the face 70 to axial loading as it would decrease the portion of the loading that would cause radial contraction of the segmented end 46. And a larger locking angle 74 would likewise decrease the resistance of the face 70 to the axial loading. Also, in the present embodiment the angles 76 are larger than the angles 74 so that the locking sleeve 44 provides less resistance to being disengaged from the piston 34 (e.g., by rotating the locking rod 56 to retract the locking sleeve 44) than to axial loading caused by the ram 30.

In the embodiment depicted in FIG. 13, the grooves 50 are uniform and have equal locking angles 74 for each groove. But in other embodiments the grooves 50 may differ from one another. For instance, in the embodiment depicted in FIG. 14 the locking angles of the grooves 50 decrease in size progressively moving from left to right. Particularly, the depicted grooves 50 have left faces 80, 82, and 84 (formed at angles 92, 94, and 96 with respect to the normal) and right faces 86, 88, and 90 (formed at locking angles 98, 100, and 102 with respect to the normal). The sequential decreasing of the locking angles of the grooves 50 results in the locking sleeve 44 becoming more resistive to axial loading from the piston 34 as it is driven further over the segmented end 46. Of course, the grooves 50 in other embodiments may vary in other ways, such as by having increasing locking angles or varying depths.

From the above description, it will be appreciated that the presently disclosed locking assembly is a spring-loaded and load-limiting locking device that, when engaged, maintains a ram in a locked position and within a specific load range that ensures sealing while limiting force needed to unlock the device. Additional loading on the locking device (e.g., as a result of a reduction in hydraulic pressure on the ram) can be reduced through operation of the linear clutch, thereby reducing the amount of force needed to overcome such loading and unlock the device. It is further noted that while the locking sleeve 44 is described above as having exterior grooves 50 that engage interior grooves 68 of the piston 34, other embodiments may have different configurations while still providing a linear clutch that reduces axial loading on the locking sleeve 44. For instance, in one embodiment the piston 34 could have a protrusion with external grooves that cooperate with internal grooves on the locking sleeve 44 (i.e., the protrusion on the piston 34 could be inserted into the sleeve 44 rather than the sleeve 44 being inserted into recess 60 of the piston 34). And in other embodiments, the linear clutch could include other components that enable the reduction of axial loading from sealed rams 30. Still further, it is noted that the linear clutches described above are not limited to use in a blowout preventer, and they may be used to reduce loading in other systems in full accordance with the present techniques.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a blowout preventer having a hollow body;

a ram disposed in the hollow body;

an actuation assembly coupled to the ram; and a linear clutch having a locking sleeve positioned to enable an end of the locking sleeve to engage the actuation assembly and lock the actuation assembly and the ram into place, wherein the end of the locking sleeve is segmented and includes at least one groove to engage a complementary surface of the actuation assembly, and wherein the linear clutch enables reduction of axial loading on the locking sleeve from compression of a packer of the ram while the end of the locking sleeve engages the actuation assembly and locks the actuation assembly and the ram into place.

2. The system of claim 1, wherein the at least one groove is disposed on an outer surface of the end of the locking sleeve and the complementary surface of the actuation assembly includes a bore of a recess of the actuation assembly.

3. The system of claim 2, wherein the recess of the actuation assembly is a recess in a piston of the actuation assembly.

4. The system of claim 2, wherein the at least one groove includes a plurality of concentric grooves disposed on the outer surface of the end of the locking sleeve.

5. The system of claim 4, wherein each concentric groove of the plurality of concentric grooves has a locking angle equal to the locking angles of the other concentric grooves.

6. The system of claim 4, wherein the bore of the recess of the actuation assembly includes a plurality of additional grooves configured to engage the plurality of concentric grooves on the outer surface of the end of the locking sleeve.

7. The system of claim 6, wherein the segmentation of the end of the locking sleeve permits radial compression of the end of the locking sleeve to enable potential energy stored in the packer of the ram to drive the actuation assembly onto the end of the locking sleeve to reduce the potential energy stored in the packer.

8. The system of claim 1, wherein the locking sleeve is threaded onto a locking rod and the locking sleeve and locking rod are configured such that rotation of the locking rod causes axial translation of the locking sleeve along the locking rod.

9. The system of claim 8, comprising a motor attached to drive rotation of the locking rod.

10. The system of claim 8, comprising an outer sleeve disposed radially outward from the locking rod and the locking sleeve.

11. The system of claim 10, wherein a piston of the actuation assembly is mounted on the outer sleeve in a manner that enables the piston to move axially along the outer sleeve.

12. A system comprising:

a ram disposed in a hollow body of a blowout preventer;

an operating piston coupled to the ram;

a locking sleeve configured to engage the operating piston and to operate as a linear clutch that reduces potential energy stored in a sealing element of the ram when the ram is in a closed position by enabling the ram to move with respect to the locking sleeve to reduce compression of the sealing element, and reduce axial loading on the locking sleeve from the sealing element via the ram and the operating piston, while the ram remains in the closed position.

13. The system of claim 12, wherein the locking sleeve includes a plurality of grooves spaced axially apart along the exterior of the locking sleeve.

14. The system of claim 12, wherein the locking sleeve has a segmented end configured to engage the operating piston.

15. The system of claim 12, wherein the operating piston is coupled to the ram with a connecting rod.

16. The system of claim 12, wherein the ram is a pipe ram.

17. The system of claim 12, comprising the blowout preventer including the hollow body, the ram, the operating piston, and the locking sleeve.

18. A method comprising:

moving a ram to a closed position in a blowout preventer by applying a pressure to a piston coupled to the ram;

compressing a packer of the ram while the ram is in the closed position;

moving an end of a sleeve into locking engagement with the piston while the ram is in the closed position; and maintaining the ram in the closed position through the locking engagement of the sleeve and the piston while allowing the ram and the piston to move axially with respect to the sleeve to reduce compression of the packer of the ram and reduce an axial load transmitted to the sleeve from the ram via the piston.

19. The method of claim 18, allowing the ram and the piston to move axially with respect to the sleeve includes allowing the piston to be driven along a grooved surface of the sleeve.

20. The method of claim 19, comprising rotating a locking rod to disengage the grooved surface of the sleeve from a complementary grooved surface of the piston.

* * * * *